US005979797A

United States Patent [19]

Castellano

[11] Patent Number: 5,979,797

[45] Date of Patent: Nov. 9, 1999

[54] HANDHELD PRESSURIZED HOPPER GUN AND METHOD

[76] Inventor: Michael A. Castellano, 25503 Kingston Ct., Calabasas, Calif. 91302

[21] Appl. No.: 09/134,629

[22] Filed: Aug. 14, 1998

[51] Int. Cl.[6] ..... B05B 7/30; B05B 9/00

[52] U.S. Cl. ..... 239/346; 239/365; 239/366; 239/369; 239/376; 239/373; 239/377; 239/379

[58] Field of Search ..... 239/310, 311, 239/316, 337, 345, 346, 354, 364, 365, 366, 369, 373, 375, 376, 377, 379, 294

[56] References Cited

U.S. PATENT DOCUMENTS

| | | | |
|---|---|---|---|
| 1,559,666 | 11/1925 | Bernier . | |
| 1,933,543 | 11/1933 | Anderson | 91/45 |
| 2,886,252 | 5/1959 | Ehrensperger | 239/354 |
| 2,901,182 | 8/1959 | Cragg et al. | 239/129 |
| 3,001,829 | 9/1961 | De Saint-Martin | 302/53 |
| 3,007,744 | 11/1961 | Ward et al. | 302/53 |
| 3,236,459 | 2/1966 | McRitchie | 239/416 |
| 3,442,454 | 5/1969 | Stenger et al. | 239/85 |
| 3,604,758 | 9/1971 | Flain et al. | 302/24 |
| 3,976,332 | 8/1976 | Fabel | 302/57 |
| 4,174,071 | 11/1979 | Lau et al. | 239/365 X |
| 4,863,104 | 9/1989 | Masterson | 239/345 |
| 4,932,594 | 6/1990 | Kim | 241/19 |
| 5,069,389 | 12/1991 | Bitsakos | 239/345 X |
| 5,119,992 | 6/1992 | Grime | 239/364 |
| 5,236,128 | 8/1993 | Morita et al. | 239/365 X |
| 5,415,351 | 5/1995 | Otto et al. | 239/345 |
| 5,695,125 | 12/1997 | Kumar | 239/364 |
| 5,713,519 | 2/1998 | Sandison et al. | 239/369 X |

FOREIGN PATENT DOCUMENTS

| | | | |
|---|---|---|---|
| 504615 | 6/1951 | Belgium | 299/86 |
| 536322 | 10/1931 | Germany | 43/148 |
| 917895 | 9/1954 | Germany | 299/86 |
| 1065337 | 9/1959 | Germany | 239/365 |

OTHER PUBLICATIONS

Advertising specification sheet by Marshalltown (date unknown) Title: Texturemate Drywall Hopper Gun.

*Primary Examiner*—Andres Kashinkow
*Assistant Examiner*—Robin O. Evans
*Attorney, Agent, or Firm*—John S. Christopher

[57] ABSTRACT

A handheld pressurized hopper gun for use in patching acoustic ceilings and repairing cracks and damage in walls and ceilings by applying a texturized sealing compound thereto is disclosed. The pressurized hopper gun is typically employed where plaster walls and ceilings are being refurbished due to damage thereto. The handheld pressurized hopper gun includes a spray gun, a pressurized sealed hopper mounted over the spray gun and containing a sealing compound, and a pressurized air input. The pressurized air input provides low pressure air from an air input housing to an air regulator and the spray gun and to a cock valve and the pressurized sealed hopper. The spray gun has a handle having a first air passage formed therethrough, a movable hollow plunger shaft having a second air passage formed therethrough, a nozzle for seating an end of the hollow plunger shaft and an orifice formed through the nozzle. The orifice and the second air passage are aligned and communicate with the first air passage so that low pressure air is constantly passing through the spray gun. A trigger is included for unseating the hollow plunger shaft from the nozzle so that the sealing compound is dispensed out the orifice under air pressure. A flexible air line connecting the air input housing to the pressurized sealed hopper includes a pressure gauge combined with the cock valve for controlling the low pressure air supplied to the sealed hopper.

15 Claims, 5 Drawing Sheets

HANDHELD PRESSURIZED HOPPER GUN AND METHOD

BACKGROUND OF THE INVENTION

1. Field of the Invention

The present invention relates to the repair of texturized walls and ceilings in residences, office buildings and the like. More specifically, the present invention relates to methods and apparatus for a portable, handheld pressurized hopper gun for use in patching acoustic ceilings and repairing cracks and damage in and the texturizing of walls and ceilings by applying a texturized sealing compound thereto.

2. Description of the Related Art

The relevant art is directed to hopper type spray devices used in the building trades. The hopper type spray devices of the prior art are typically employed for use in (a) texturizing of walls and ceilings and (b) plaster patching. Several hopper type spray devices are known in the prior art.

One example comprised a drywall hopper apparatus having a hopper container in which drywall repair ingredients were mixed by hand and poured into the hopper container. In the alternative, the hopper container could be motorized to provide rotational motion for mixing the ingredients. Once mixed, a pump was employed to draw the mixed ingredients through a material hose. The material hose was positioned parallel to a separate air hose and the two hoses intersected at the input of a hand gun or hand pole having a spray head. The separate air hose supplied pressurized air to the spray head to aerate the mixed ingredients for spraying onto a ceiling. Optionally, a switch could be located on the drywall hopper apparatus for use in controlling the operation of the pump.

This prior art drywall hopper apparatus clearly exhibited antiquated means for patching of plaster and texturizing of walls and ceilings. The apparatus was large and difficult to handle and thus was not conveniently portable. The necessity of separate material and air lines made the apparatus even more inconvenient and difficult to transport into residences and offices. The motorized hopper container or mixer typically remained out of doors while the material and air lines were pulled into the room of the residence or office to be repaired. Often the walls, floors and carpets of the residence or office were soiled or even damaged by the equipment.

Another example of the prior art included a portable drywall hopper gun (known by the tradename Marshalltown) utilized for smaller repairs of texturized walls and ceilings. The portable drywall hopper gun included a funnel-shaped, handheld hopper which received the mixed ingredients. The funnel-shaped hopper was vertically attached to a hand gun device having a handle and trigger mechanism. Low pressure air was fed into the rear end of the hand gun device. The mixed ingredients were gravity fed down through the funnel-shaped hopper. Actuation of the trigger released the air which forced the mixed ingredients out of an adjustable orifice plate onto a wall or ceiling to be repaired. Once sprayed, the texture of the mixed ingredients could be finished with a trowel.

Several problems existed in the handheld portable drywall hopper gun known in the art. One problem was that the flow of the mixed ingredients down into the funnel-shaped hopper could not be controlled. In particular, the mixed ingredients that were intended to be gravity fed into the hand gun device often would not flow at all. In order to address this problem, liquid soap was mixed with the ingredients to form a solution which promoted the flow thereof. Unfortunately, when the trigger mechanism was actuated to admit air into the hand gun device, the mixed ingredients often failed to spray out the orifice and onto the wall or ceiling to be repaired. If the mixed ingredients were further liquified, then the texture of the resultant mixed ingredients was too fluid and would not match the texture of the wall surface surrounding the damaged portion to be repaired. Specifically, the texture of certain sealing compounds utilized on the ceiling surface (often referred to as "popcorn"), would not be sufficiently dense.

Another problem experienced with the portable drywall hopper gun included the clogging of the port leading from the bottom of the funnel-shaped hopper into the hand gun device. The mixed ingredients poured into the funnel-shaped hopper comprise a drying material, not a setting material. Even when mixed properly, the mixed ingredients would begin to dry and thus refuse to gravity flow down the port leading from the bottom of the funnel-shaped hopper into the air channel of the hand gun device. Further, the operation of the portable drywall hopper gun of the prior art was inconsistent and intermittent. The drywall hopper gun would operate and then not operate while periodically being totally inoperative. Even when the proper mixed ingredients (i.e., having a smooth grainy consistency) designed for this drywall hopper gun was employed, the drywall hopper gun would still not operate consistently.

An additional problem existing with the drywall hopper gun of the prior art is that the funnel-shaped hopper is open at the top. This presents the problem of loosing the mixed ingredient load to spillage. Further, the mixed ingredients of the funnel-shaped hopper is at atmospheric pressure which fails to overcome the problems associated with the mixed ingredients drying and clogging as discussed hereinabove. Other untranslated references that appear to be related to the present invention include German Document 917 895 (1954), German Document 1 065 337 (1955) and Belgium Document 504 615 (1951).

Thus, there is a need in the art for a handheld pressurized hopper gun that is conveniently portable, includes a low pressure air input at the base of the handle of a spray gun that continuously feeds low pressure air to both the spray gun and a pressurized sealed hopper through air regulating devices to provide flow control of the mixed ingredients and to prevent damage to the sealed hopper, where the spray gun includes a trigger that when actuated causes only the mixed ingredients to be dispensed and a hollow plunger shaft that continuously passes pressurized air from the air input through the spray gun to force mixed ingredients out a nozzle orifice.

SUMMARY OF THE INVENTION

Briefly, and in general terms, the present invention provides a new and improved handheld pressurized hopper gun for use in patching acoustic ceilings and repairing cracks and damage in and the texturizing of walls and ceilings by applying a texturized sealing compound thereto. The novel and non-obvious handheld pressurized hopper gun exhibits a robust lightweight design which is useful in repairing cracks and damage in walls and ceilings.

The inventive hopper gun includes a low pressure air nozzle which is affixed to the invention beneath the handle thereof. The low pressure air enters the hopper gun at an air input housing and is applied to a spray gun and to a pressurized sealed hopper, simultaneously. The low pressure air is regulated prior to entering both the spray gun and the pressurized sealed hopper. The air input housing is connected to the pressurized sealed hopper via a flexible air line having a cock valve and pressure gauge in-line therewith. Thus, the sealed hopper is under controlled pressure which enables the sealing compound in combination with water (and known as mixed ingredients) to be reliably delivered to the spray gun. The low pressure air from the air input housing passes through a regulator prior to entering the handle of the spray gun. A first air passage in the handle communicates with a second air passage formed in a movable hollow plunger shaft passing through the spray gun. The low pressure air is constantly passing through the spray gun. A trigger is arranged to move the hollow plunger shaft seated on a nozzle. Actuation of the trigger enables the constantly present mixed ingredients to be ejected out of a nozzle orifice under air pressure. A spring-loaded adjustment knob controls the travel of the trigger and the volume of the mixed ingredients (i.e., sealing compound in combination with water) discharged from the nozzle of the spray gun.

The handheld pressurized hopper gun of the present invention is generally directed to plaster repair and is typically employed at construction sites where plaster walls and ceilings are being refurbished due to damage thereto. In its most fundamental embodiment, the handheld pressurized hopper gun comprises a construction including a spray gun, a pressurized sealed hopper mounted over the spray gun and containing a sealing compound in combination with water, and a pressurized air input. The pressurized air input provides low pressure air from an air input housing to an air regulator and the spray gun and also to a cock valve and the pressurized sealed hopper.

The spray gun has a handle having a first air passage formed therethrough, a movable hollow plunger shaft having a second air passage formed therethrough, a nozzle for seating a forward end of the hollow plunger shaft and an orifice formed through the nozzle. The orifice and the second air passage are aligned and communicate with the first air passage so that low pressure air is constantly passing through the spray gun. A trigger is included for unseating the hollow plunger shaft from the nozzle so that the mixed ingredients (comprising the sealing compound in combination with water) are dispensed out the orifice under air pressure. A flexible air line connecting the air input housing to the pressurized sealed hopper includes a pressure gauge combined with the cock valve for controlling the low pressure air supplied to the sealed hopper. The controlled air pressure enables the flow rate of the mixed ingredients (i.e., sealing compound in combination with water) from the sealed hopper to the spray gun to be regulated. Since the air pressure is controlled, damage to and distortion of the sealed hopper is avoided.

In a preferred embodiment, the handheld pressurized hopper gun includes an adjustment knob having a spring mounted within a hollow formed in the adjustment knob. The adjustment knob controls the tension on the spring and thus the travel of the trigger. The travel of the trigger, in turn, controls the volume of the mixed ingredients (i.e., sealing compound in combination with water) discharged from the nozzle of the spray gun.

These and other objects and advantages of the present invention will become apparent from the following more detailed description, taken in conjunction with the accompanying drawings which illustrate the invention, by way of example.

DESCRIPTION OF THE INVENTION

Figure 1:
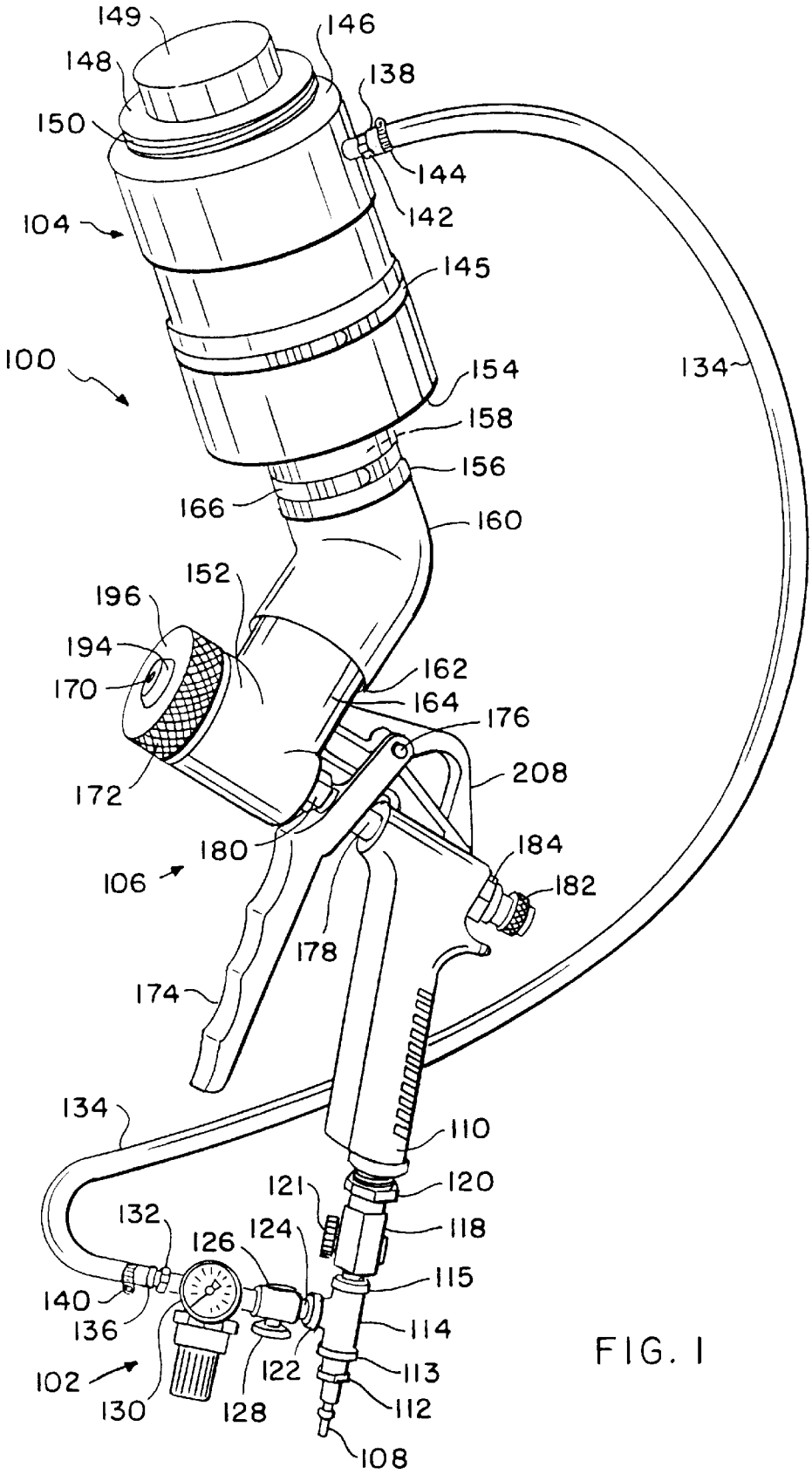
FIG. 1 is a side perspective view of a handheld pressurized hopper gun of the present invention showing a pressurized sealed hopper connected to a spray gun via a connection neck, both the sealed hopper and spray gun being connected to a low pressure air input.

The present invention is a handheld pressurized hopper gun 100 as best shown in FIG. 1 for use in patching acoustic ceilings and repairing cracks and damage in walls and ceilings. The handheld pressurized hopper gun 100 of the present invention is employed to repair cracked and damaged walls and ceilings by utilizing it to apply a texturized sealing compound to the damaged areas. Various sealing compounds of the prior art in combination with water can be utilized and, once applied, can be smoothed with a trowel prior to drying to provide a finished appearance. The handheld pressurized hopper gun 100 is typically employed at residential and commercial sites where walls and ceiling have been damaged by, for example, an earthquake.

Figure 2:
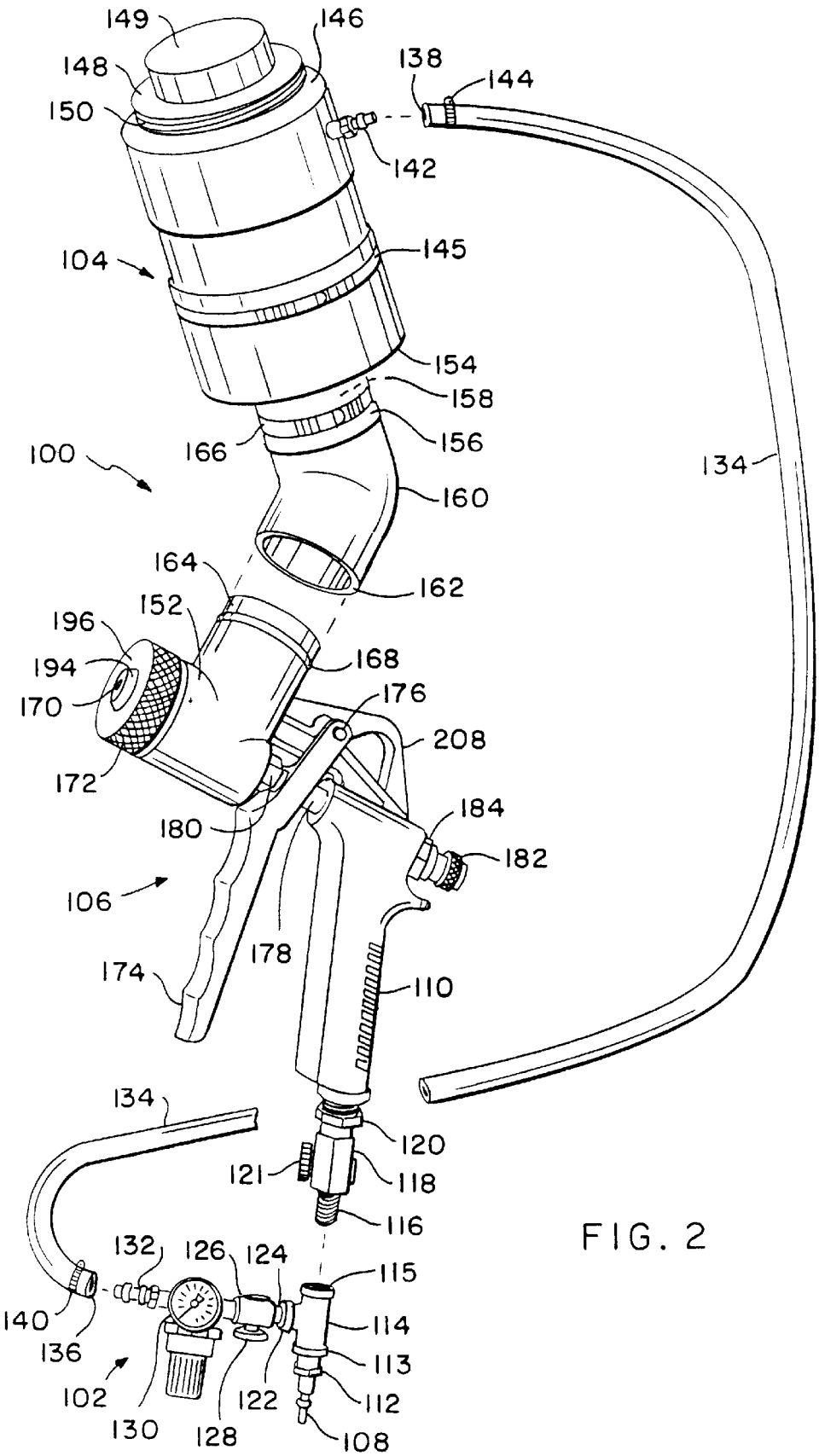
FIG. 2 is an exploded view of the handheld pressurized hopper gun of FIG. 1 showing the pressured sealed hopper and connection neck separated from the spray gun, both the sealed hopper and spray gun being separated from the low pressure air input.

A preferred embodiment of the handheld pressurized hopper gun 100 is shown in FIGS. 1–5 and includes three main sections. The three sections include a pressurized air intake section 102, a pressurized sealed hopper 104 containing a sealing compound in combination with water referred to as mixed ingredients (not shown) and a spray gun 106 shown in FIGS. 1 and 2. The pressurized air intake section 102 includes an air nipple 108 which is positioned beneath a handle 110 of the spray gun 106. The air nipple 108 is employed to interface with an external low pressure air line (not shown) used to charge the hopper gun 100 with approximately 15 pounds per square inch (psi) of pressurized air. The air nipple 108 is connected by a suitable threaded fitting 112 to a bottom opening 113 of an air input housing 114 as shown in FIGS. 1 and 2.

The air input housing 114 serves to provide a junction where the pressurized air is divided into two pathways. A first pathway for the pressurized air is directed toward the spray gun 106 and a second pathway for the pressurized air is directed toward the pressurized sealed hopper 104. In the first pathway for the pressurized air, a top opening 115 of the air input housing 114 receives a threaded fitting 116 attached to an air regulator 118 best shown in FIG. 2. The air regulator 118 is, in turn, connected to the bottom of the handle 110 of the spray gun 106 by an appropriate threaded fastener 120 shown clearly in both FIGS. 1 and 2. The air regulator 118 includes an adjustable member 121 that functions to adjust the air pressure delivered to the spray gun 106. Manual rotation of the adjustable member 121 of the air regulator 118 controls the air pressure applied to the spray gun 106.

The pressure of the air delivered to the spray gun 106 must be maintained within a specific range in order for the texture of the mixed ingredients (i.e., sealing compound in combination with water) sprayed onto a cracked or damaged wall or ceiling to match the texture of the surface surrounding the damaged area. If the pressure of the air delivered to the spray gun 106 is too high, the mixed ingredients (i.e., sealing compound in combination with water) will be too thin and runny. Likewise, if the pressure of the air delivered to the spray gun 106 is too low, the mixed ingredients (i.e., sealing compound in combination with water) will be too dense. In either case, the mixed ingredients (i.e., sealing compound in combination with water) when dried will not match the texture of the wall or ceiling surface surrounding the damaged area.

In the second pathway for the pressurized air, a side opening 122 of the air input housing 114 receives a threaded fitting 124 from a cock valve 126 shown clearly in FIGS. 1 and 2. The air pressure available at the side opening 122 of the air input housing 114 and at the input of the cock valve 126 is also approximately 15 psi. The cock valve 126 also includes an adjustable member 128 that functions to adjust the air pressure delivered to the pressurized sealed hopper 104. Rotation of the adjustable member 128 controls the volume of pressurized air that passes through the cock valve 126 to the pressurized sealed hopper 104. The cock valve 126 is directly connected to an in-line pressure gauge 130 as shown in FIGS. 1 and 2 which serves to measure the air pressure on the downstream side of the cock valve 126. The combination of the cock valve 126 and the in-line pressure gauge 130 serve to control the magnitude of the pressurized air delivered to the pressurized sealed hopper 104.

The downstream side of the in-line pressure gauge 130 includes a first nipple fitting 132 best shown in FIG. 2. A flexible air line 134 having a first end 136 and a second end 138 is also shown. The first end 136 of the flexible air line 134 is fitted over the first nipple fitting 132 and secured by a first mechanical fastener 140 as shown in FIG. 1. Likewise, the second end 138 of the flexible air line 134 is fitted over a second nipple fitting 142 extending from the pressurized sealed hopper 104 and secured by a second mechanical fastener 144. The second nipple fitting 142 is comprised of a material that is compatible with the material used to fabricate the sealed hopper 104. The first mechanical fastener 140 and the second mechanical fastener 144 retain the flexible air line 134 on the first nipple fitting 132 and the second nipple fitting 142, respectively, when the flexible air line 134 is charged. Thus, the flexible air line 134 serves as a conduit for carrying the pressurized air from the downstream side of the cock valve 126 and in-line pressure gauge 130 to the pressurized sealed hopper 104 for charging the sealed hopper 104.

The pressurized sealed hopper 104 is a container mounted above the spray gun 106 as shown in both FIGS. 1 and 2. The sealed hopper 104 functions to house the sealing compound in combination with water to form the mixed ingredients. The sealed hopper 104 can be comprised of any suitable material such as, for example, a lightweight plastic or metal. Examples include a lightweight plastic known in the industry as ABS, or polyvinylchloride known as PVC or, in the alternative, a lightweight metal such as aluminum. The material employed to fabricate the sealed hopper 104 must also be robust since the construction must be able to withstand the stresses associated with the pressurized air. In order to reinforce the cylindrical construction of the pressurized sealed hopper 104, one or more wrap around belts 145 can be employed as shown in FIGS. 1 and 2.

A top surface 146 of the sealed hopper 104 includes a threaded cap 148 which renders the sealed hopper 104 accessible for depositing and removing the mixed ingredients (i.e., sealing compound in combination with water). The threaded cap 148 includes a knob 149 and a plurality of threads 150. The knob 149 facilitates the manipulation of the threaded cap 148 so that the plurality of threads 150 mate with a corresponding set of threads (not shown) located on the inside surface of the sealed hopper 104. The threaded cap 148 is fashioned from a material that is consistent with the material utilized to fabricate the sealed hopper 104. The shape or form of the sealed hopper 104 as shown in FIGS. 1 and 2 is generally cylindrically but can assume any shape or size consistent with the scope and function of the present invention.

Since the sealed hopper 104 is intended to be pressurized, the plurality of threads 150 associated with the threaded cap 148 must fit snugly with the mating threads formed on the inside surface of the sealed hopper 104. It is noted that it is the combination of the cock valve 126 and the in-line pressure gauge 130 that controls the pressure in the sealed hopper 104. The utility of the pressure present in the sealed hopper 104 during operation is to constantly urge the mixed ingredients (i.e., sealing compound in combination with water) downward into a cavity 152 of the spray gun 106 described in more detail hereinbelow. Notwithstanding, the pressure in the sealed hopper 104 must be monitored and controlled to achieve the proper flow of the mixed ingredients (i.e., sealing compound in combination with water) into the cavity 152 of the spray gun 106. Further, the pressure in the sealed hopper 104 must also be regulated to prevent the material of the sealed hopper 104 (typically plastic) from being distorted and/or damaged.

Figure 3:
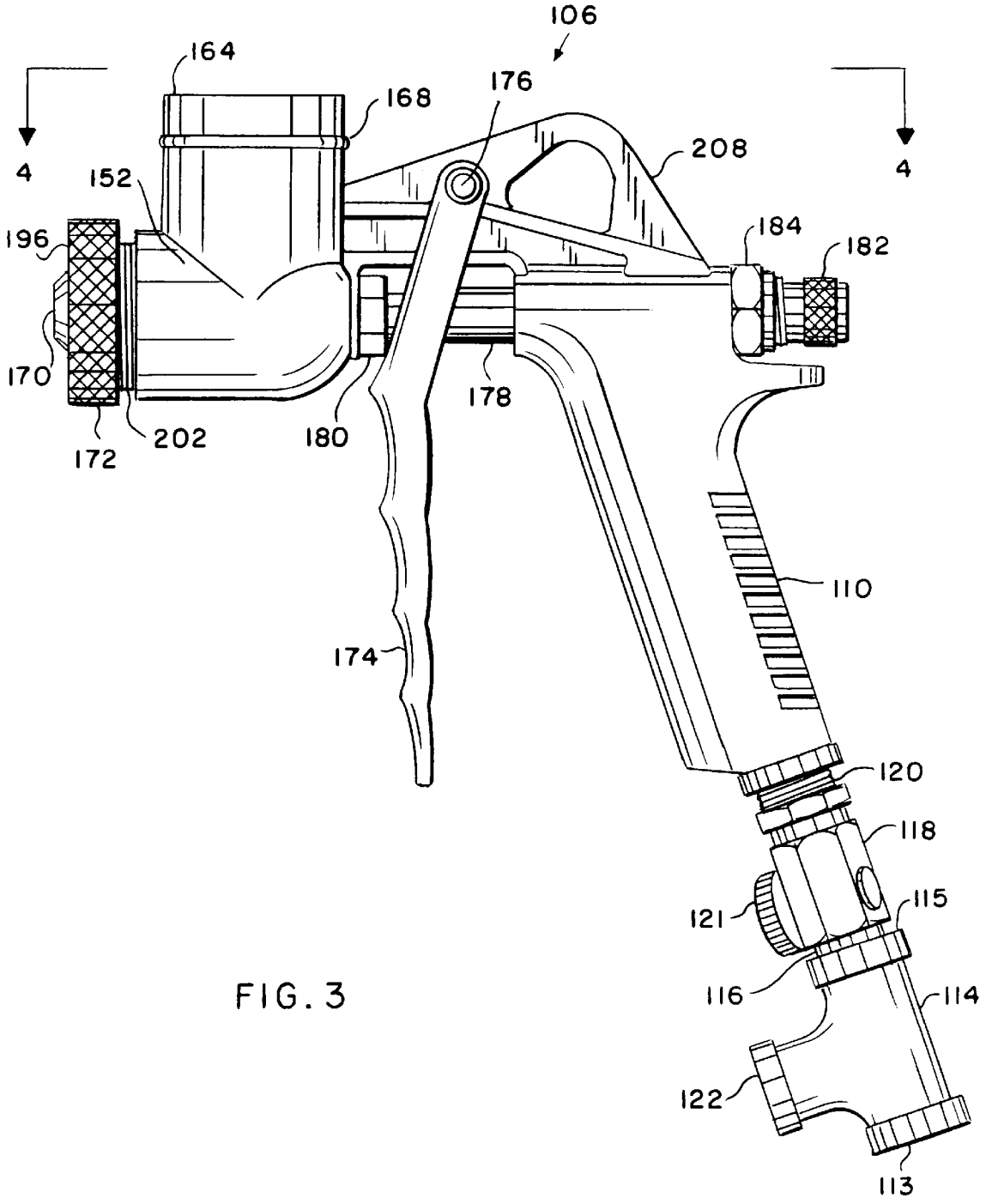
FIG. 3 is a side elevation view of the spray gun of the handheld pressurized hopper gun of FIG. 1 showing a handle, an adjustment knob, a trigger, a cavity and a nozzle.
Figure 4:
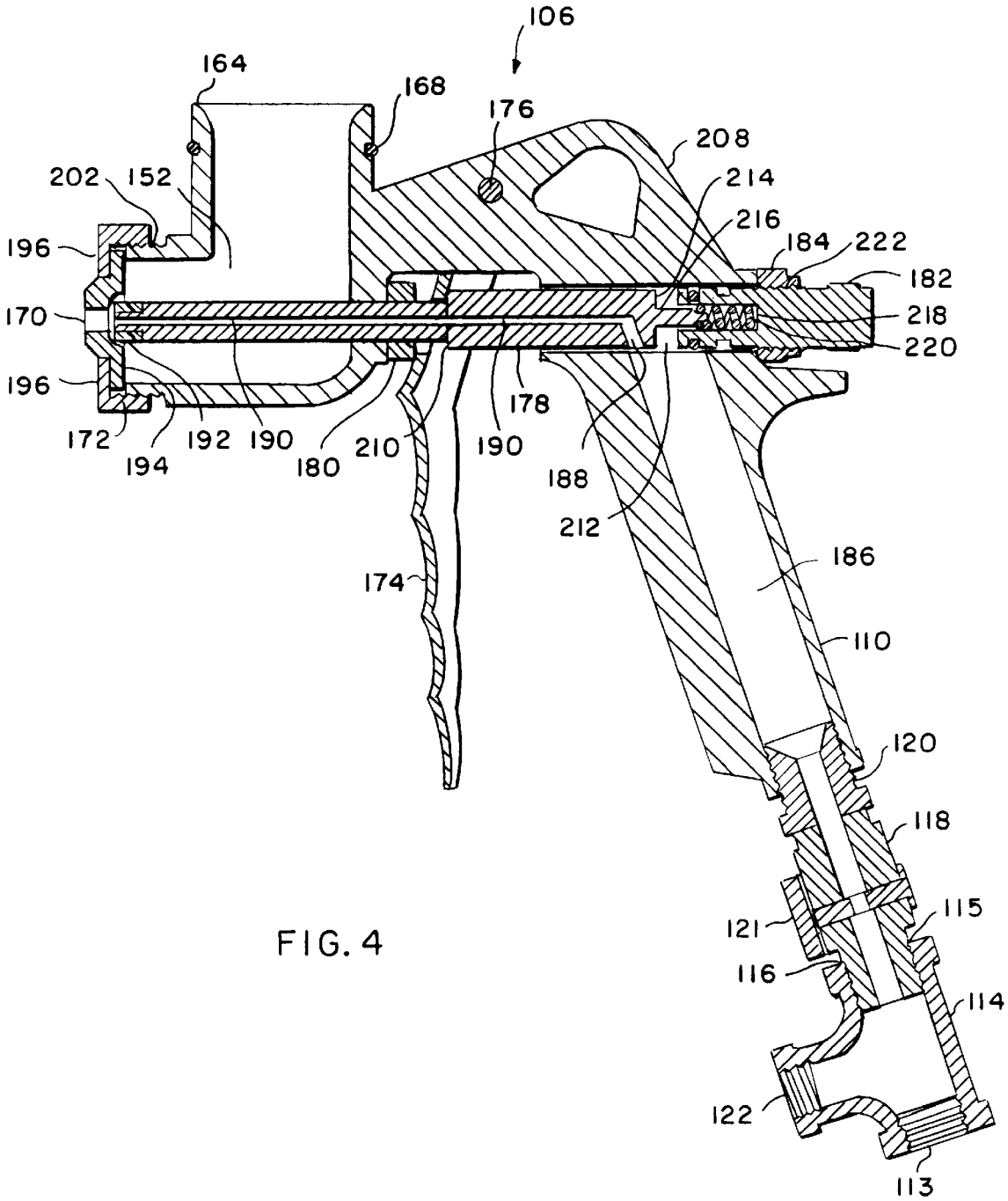
FIG. 4 is a cross-sectional view of the spray gun taken along line 4—4 of FIG. 3 showing the interior of the handle, the adjustment knob, the trigger, the cavity and the nozzle.

The bottom surface 154 of the sealed hopper 104 reduces down to a circular pipe 156 as shown in FIGS. 1 and 2. The bottom of the circular pipe 156 slides over a top end 158 of a connection neck 160 while a bottom end 162 of the connection neck 160 fits over an upward extending mouth 164 of the cavity 152 of the spray gun 106 as shown in FIGS. 1 and 2. The circular pipe 156 fits snugly over the top end 158 of the connection neck 160 by the use of a third mechanical fastener 166. However, the bottom end 162 of the connection neck 160 is force-fitted over an annular rib 168 formed on the exterior of the upward extending mouth 164 of the cavity 152 as shown in FIGS. 2–4. If desired, a mechanical fastener similar to the third mechanical fastener 166 shown in FIGS. 1 and 2 can be utilized to retain the bottom end 162 of the connection neck 160 to the upward extending mouth 164 of the cavity 152. The circular pipe 156 and the connection neck 160 are each comprised of a material compatible with the material forming the sealed hopper 104 and the upward extending mouth 164 of the spray gun 106, respectively.

When it is desired to utilize the pressurized hopper gun 100, the sealing compound must be prepared to form the mixed ingredients. The sealing compound employed is selected based upon the type of surface or ceiling being repaired. For example, if a stipple wall surface is being repaired, the sealing compound typically selected for use is known in the art as Wall Texture. Conversely, if a ceiling surface having a stipple finish or a popcorn texture finish is being repaired, the sealing compound typically selected for use is known in the art as Dry Acoustic. Both the Wall Texture and the Dry Acoustic types of sealing compounds are known in the art and are available at standard building hardware and construction supply companies. Each of these sealing compounds are then mixed with water either by hand or by a separate motor driven apparatus (unrelated to the present invention) to form the mixed ingredients. The volume of water utilized in the mix is controlled by the amount of sealing compound used and the desired consistency of the mixed ingredients.

Once the sealing compound and water are mixed, the knob 149 of the threaded cap 148 is rotated in a direction to remove the threaded cap 148 from the sealed hopper 104. The sealed container 104 is then at atmospheric pressure. The mixed ingredients are then poured into the pressurized sealed hopper 104 and the threaded cap 148 is employed to seal the hopper 104. Once the hopper 104 is securely sealed, the cock valve 126 is adjusted to control the low air pressure transmitted from the air input housing 114 to the sealed hopper 104 via the flexible air line 134. After the sealed hopper 104 is charged to the appropriate pressure, the mixed ingredients are forced downward through the circular pipe 156, the connection neck 160, the upward extending mouth 164 and into the cavity 152 of the spray gun 106. The mixed ingredients (i.e., sealing compound in combination with water) will thereafter be present in the cavity 152 for discharge from an orifice 170 of a nozzle 172 of the spray gun 106.

The spray gun 106 which functions to combine the pressurized air and mixed ingredients together for discharge from the orifice 170 is best shown in FIGS. 3 and 4. FIG. 3 is a side illustration of the spray gun 106 and includes the handle 110, the cavity 152, the orifice 170 and the nozzle 172. Also shown is a trigger 174 attached to a pivot point 176, a hollow plunger shaft 178 resting against a forward abutment 180, and a threaded adjustment knob 182 mounted at the rear of the spray gun 106 against a rear securing bolt 184. In addition to serving as a resting point for the trigger 174, the forward abutment 180 also serves to support and maintain the alignment of the hollow plunger shaft 178 along the horizontal axis of the spray gun 106. Likewise, the rear securing bolt 184 also serves to support and maintain the alignment of the threaded adjustment knob 182 as can be seen in the cross-sectional view of FIG. 4.

The handle 110 includes an air channel 186 formed therein as is best shown in FIG. 4. The air channel 186 serves as a first air passage for the low pressure air injected into the spray gun 106 from the external low pressure air line (not shown) via the air input housing 114 and air nipple 108. The pressurized air exits the air input housing 114 and enters the air regulator 118 as shown in FIG. 4. Manual rotation of the adjustable member 121 of the air regulator 118 controls the air pressure that is applied to the spray gun 106. Once the air regulator 118 is adjusted, the air pressure applied to the handle 110 of the spray gun 106 remains constant until the adjustable member 121 of the air regulator 118 is adjusted anew. The pressurized air applied to the air channel 186 of the handle 110 enters an opening 188 located in the back end of the hollow plunger shaft 178 as is clearly shown in FIG. 4. The opening 188 communicates with a hollow pathway 190 formed through the entire horizontal length of the hollow plunger shaft 178. The hollow pathway 190 serves as a second air passage for the pressurized air injected into the spray gun 106.

FIG. 4 clearly shows the opening 188 communicating with the air channel 186. As will be discussed in more detail hereinbelow, operation of the trigger 174 results in the hollow plunger shaft 178 moving from the position shown in FIG. 4 toward the threaded adjustable knob 182, i.e., from left-to-right. When the hollow plunger shaft 178 moves closer to the threaded adjustable knob 182, the opening 188 also moves toward the adjustment knob 182. It is noted that the opening 188 has been positioned with respect to the air channel 186 in the handle 110 so that the opening 188 continues to communicate with the air channel 186 when the hollow plunger shaft 178 is moved toward and away from the adjustment knob 182. In this manner, the air channel 186 serving as a first air passage always communicates with the opening 188 and the hollow pathway 190 serving as the second air passage of the spray gun 106.

A forward end 192 of the hollow plunger shaft 178 is shown seated against the inner surface of an orifice plate 194. The hollow pathway 190 of the hollow plunger shaft 178 is also aligned with the orifice 170 formed in the orifice plate 194. Therefore, the pathway for the pressurized air is continuous and uninterrupted from the air regulator 118 to the orifice 170 as is shown in FIG. 4. It is noted that pressurized air passes through the hollow pathway 190 constantly. Further, the air pressure constantly applied to the spray gun 106, once regulated by the air regulator 118, remains at constant pressure. Operation of the trigger 174 does not affect the air pressure applied to the spray gun 106 since the pressurized air constantly passes through the hollow pathway 190 and the orifice 170. Notwithstanding, the mixed ingredients (i.e., sealing compound in combination with water) that are constantly urged into the cavity 152 from the pressurized sealed hopper 104 are prevented from passing through the orifice 170 until the forward end 192 of the hollow plunger shaft 178 is withdrawn from its seat on the inside surface of the orifice plate 194. When the forward end 192 of the hollow plunger shaft 178 is withdrawn from its seat on the inside surface of the orifice plate 194 by operation of the trigger 174, the mixed ingredients are forced out the orifice 170 under air pressure.

Figure 5:
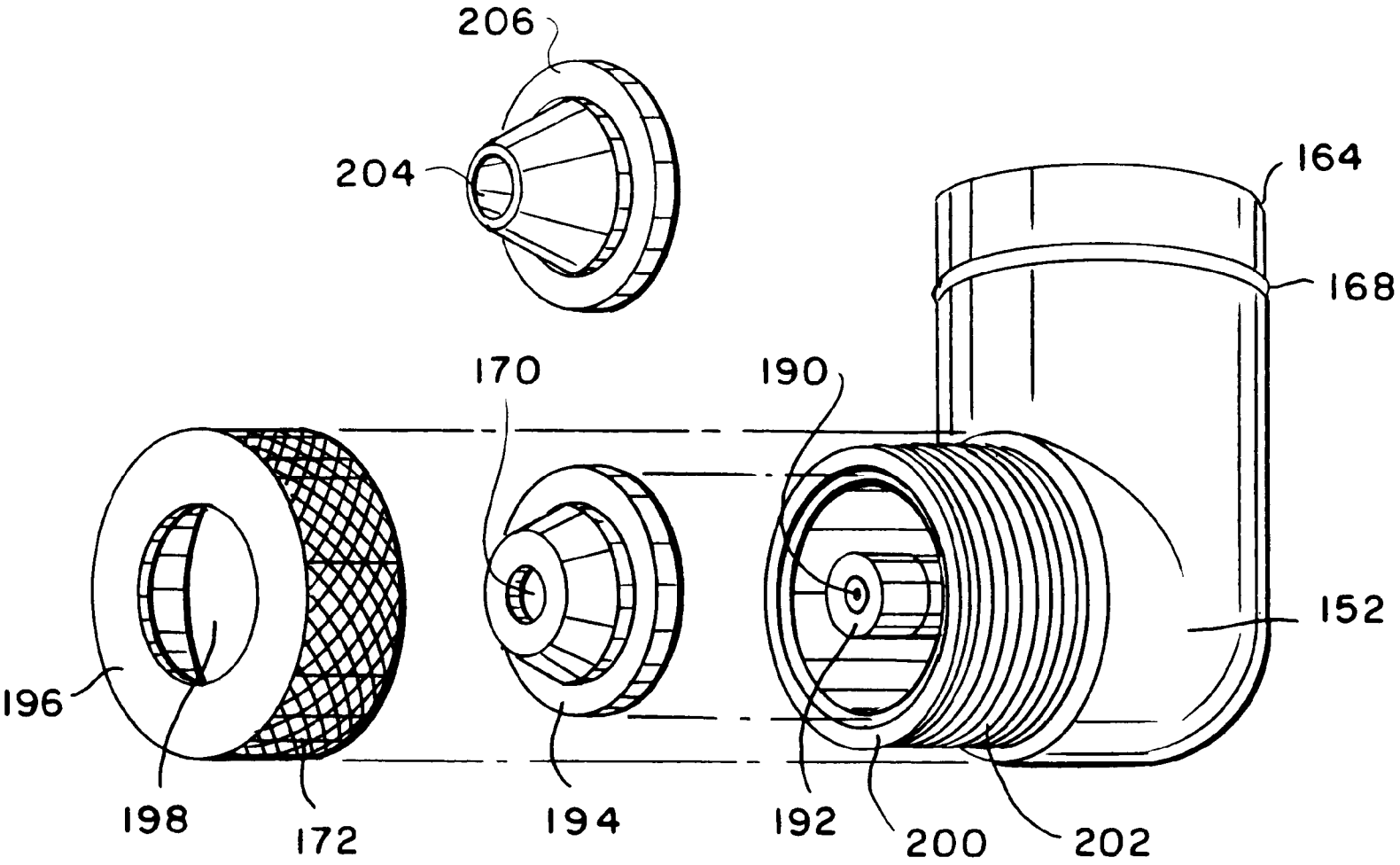
FIG. 5 is a detail view, in perspective, of the cavity and nozzle assembly of FIG. 3 showing the nozzle head disassembled and illustrating a pair of nozzle orifices.

The orifice 170 and the nozzle 172 are positioned on the forward end of the spray gun 106 just adjacent to the cavity 152 as is clearly shown in FIGS. 4 and 5. In the preferred embodiment, the nozzle 172 is shown as a cylindrical structure which is threaded on the inside. The nozzle 172 is open on the interior side and partially closed on the exterior side by a torodial surface 196 best shown in FIG. 5. A penetration 198 inherent within the torodial surface 196 enables the orifice 170 to project therethrough as is shown in FIGS. 3 and 4. The torodial surface 196 captures the orifice plate 194 of the orifice 170 and holds it against a forward terminal end 200 of the spray gun 106. The forward terminal end 200 of the spray gun 106 includes a plurality of threads 202 on its outer surface that mate with the threads on the inside of the nozzle 172. Thus, the nozzle 172 can be threaded on and off of the forward terminal end 200 to remove and reinstall the orifice 170, to clean the spray gun 106 or to replace the orifice 170 with an alternative orifice 204 shown in FIG. 5. The alternative orifice 204 exhibits a structure similar to orifice 170 including an orifice plate 206. Use of orifice 170 or orifice 204 as alternatives enables the amount of mixed ingredients (i.e., sealing compound in combination with water) and thus the texture and the spray pattern to be controlled. The forward end 192 of the hollow plunger shaft 178 is shown aligned with the orifice 170 in FIG. 5.

The cavity 152 is positioned directly beneath the pressurized sealed hopper 104 best shown in FIG. 1. The upward extending mouth 164 receives the mixed ingredients (i.e., sealing compound in combination with water) under pressure from the sealed hopper 104. The mixed ingredients are then urged down into the cavity 152. The hollow plunger shaft 178 passes directly through the cavity 152 and the mixed ingredients as is clearly shown in FIG. 4. It is the forward end 192 of the hollow plunger shaft 178 seated on the inner surface of the orifice plate 194 that prevents the escape of the mixed ingredients out of the orifice 170.

The trigger 174 serves as the mechanism that operates the hollow plunger shaft 178 back and forth in the horizontal direction within the cavity 152 of the spray gun 106. The trigger 174 is attached to the pivot point 176 best shown in FIG. 3. The pivot point 176 is mounted to a support structure 208 which is unitary with the upward extending mouth 164 of the cavity 152 and with the top of the handle 110 best shown in FIGS. 3 and 4. The trigger 174 is positioned between the forward abutment 180 and a shoulder 210 formed on the hollow plunger shaft 178 clearly shown in FIG. 4. The forward abutment 180 functions as the forward resting point of the trigger 174 when the trigger 174 is in the non-operated position.

The shoulder 210 functions as the means by which the trigger 174 operates the hollow plunger shaft 178 in the horizontal direction with respect to the spray gun 106. The hollow plunger shaft 178 passes through or adjacent to the structure of the trigger 174. The structure is arranged so that when the trigger 174 is depressed, it catches the shoulder 210 formed on the hollow plunger shaft 178 and carries the hollow plunger shaft 178 with the trigger 174. This causes the forward end 192 of the hollow plunger shaft 178 to unseat from the inner surface of the orifice plate 194. Mixed ingredients are then discharged under air pressure from the orifice 170. Thus, the trigger 174 serves only to facilitate the discharge of the mixed ingredients from the spray gun 106 and does not control the operation of the pressurized air. This is the case since the pressurized air is constantly passing through the hollow pathway 190 of the hollow plunger shaft 178 whether the trigger 174 is operated or not.

In order for the hollow plunger shaft 178 to be carried with the trigger 174 when the trigger 174 is depressed, a gap 212 must exist between the hollow plunger shaft 178 and the threaded adjustable knob 182 as is shown in FIG. 4. If the gap 212 did not exist, then the hollow plunger shaft 178 would abut against the threaded adjustment knob 182 and the trigger 174 would be immovable. As a result, the forward end 192 of the hollow plunger shaft 178 would not be unseated and mixed ingredients would not be discharged from the orifice 170. The rear end 214 (i.e., the far right side) of the hollow plunger shaft 178 includes a reduced size extension 216 shown clearly in FIG. 4.

The threaded adjustment knob 182 includes an open-ended hollow 218 as is shown in FIG. 4. The open-ended hollow 218 is in alignment with the reduced size extension 216 and sized to receive the same. Mounted within the open-ended hollow 218 is a spring 220. The reduced size extension 216 fits into the open-ended hollow 218 and contacts the spring 220. When the trigger 174 is not depressed, the spring 220 exhibits a tension level $T_1$. However, when the trigger 174 is depressed, the reduced size extension 216 (which moves with the trigger 174) is moved further into the open-ended hollow 218. The spring 220 is then further compressed and exhibits a tension level $T_2$ where $T_2 > T_1$. Depending upon the position of the threaded adjustment knob 182, the spring 220 functions to provide some limit to the travel of the reduced size extension 216 into the open-ended hollow 218. During the time that the trigger 174 is depressed, the forward end 192 of the hollow plunger shaft 178 is unseated and mixed ingredients are discharged from the orifice 170. The spring 220 also functions as a return mechanism for the trigger 174 to the non-depressed position, i.e., where the trigger 174 rests upon the forward abutment 180. The spring 220 once again will exhibit a non-depressed tension level $T_1$.

The volume of mixed ingredients (i.e., sealing compound in combination with water) discharged from the orifice 170 after the trigger 174 is depressed is dependent upon the distance that the forward end 192 of the hollow plunger shaft 178 is displaced from the orifice plate 194. This distance is, in turn, controlled by the range of motion of the trigger 174. The range of motion of the trigger 174 is controlled by the setting of the threaded adjustment knob 182 in the following manner. The threaded adjustment knob 182 includes a plurality of threads 222 that mate with corresponding threads located within the rear securing bolt 184 as is shown in FIG. 4. Thus, the position of the threaded adjustment knob 182 controls the position of the open-ended hollow 218 and consequently the spring 220. Thus, the position of the threaded adjustment knob 182 on the rear end of the spray gun 106 controls the spring pressure on the reduced size extension 216, the hollow plunger shaft 178 and the trigger 174.

By adjusting the position of the threaded adjustment knob 182, the size of the gap 212 between the hollow plunger shaft 178 and the adjustment knob 182 is varied. In addition, the tension on the spring 220 is modified. The size of the gap 212 and the tension in the spring 220 serve to control the range of travel in the trigger 174. For example, if the adjustment knob 182 is threaded inward (i.e., toward the hollow plunger shaft 178), the tension in spring 220 is increased. This is because the position of the reduced size extension 216 is fixed when the trigger 174 is not operated. Thus, when the adjustment knob 182 is threaded toward the hollow plunger shaft 178, the tension in the spring 220 is increased. Additionally, the gap 212 is caused to become smaller because the adjustment knob 182 is moved closer to the hollow plunger shaft 178. Thus, the range of movement in the trigger 174 is reduced. The gap 212 serves to provide space for the movement of the hollow plunger shaft 178 when the trigger 174 is depressed before the adjustment knob 182 is encountered. Likewise, if the adjustment knob 182 is threaded outward (i.e., away from the hollow plunger shaft 178), the tension in spring 220 is decreased. Thus, when the adjustment knob 182 is threaded away from the fixed position, reduced size extension 216, the tension in the spring 220 is decreased. Further, the gap 212 is caused to become larger since the adjustment knob 182 is moved further away from the hollow plunger shaft 178. Thus, the range of movement in the trigger 174 is increased.

The main function of the threaded adjustment knob 182 is to control the volume of mixed ingredients (i.e., sealing compound in combination with water) admitted to and discharged from the orifice 170 when the trigger 174 is depressed. Operation of either the threaded adjustment knob 182 or the trigger 174 does not affect the air pressure applied to the spray gun 106 since the pressurized air constantly passes through the hollow pathway 190 and the orifice 170. The volume of the mixed ingredients discharged is controlled by the adjustment knob 182 which functions as a stop. For example, if the handheld pressurized hopper gun 100 is employed to repair or patch a small area of plaster, then the adjustment knob 182 is threaded inward (toward the hollow plunger shaft 178). Under these conditions, the open-ended hollow 218 moves toward the reduced size extension 216 so that more pressure is applied to the spring 220. Inward movement of the adjustment knob 182 causes the size of the gap 212 to be reduced. Thus, the available range of movement of the trigger 174 is decreased. As a result, the forward end 192 of the hollow plunger shaft 178 unseats from the orifice plate 194 a small distance enabling only a small volume of mixed ingredients to escape from the orifice 170 under constant air pressure. When the trigger 174 is released, the spring 220 forces the forward end 192 of the hollow plunger shaft 178 back onto the orifice plate 194 to reseal the orifice 170.

In the alternative, if the hopper gun 100 is employed to repair or patch a larger area of plaster, then the adjustment knob 182 is threaded outward (away from the hollow plunger shaft 178). Under these conditions, the open-ended hollow 218 moves away from the reduced size extension 216 so that less pressure is applied to the spring 220.

Outward movement of the adjustment knob 182 causes the size of the gap 212 to be increased. Thus, the available range of movement of the trigger 174 is increased. As a result, the forward end 192 of the hollow plunger shaft 178 unseats from the orifice plate 194 a greater distance enabling a larger volume of mixed ingredients to escape from the orifice 170 under constant air pressure. As before, when the trigger 174 is released, the spring 220 forces the forward end 192 of the hollow plunger shaft 178 back onto the orifice plate 194 to reseal the orifice 170.

The present invention provides novel advantages over other hopper type spray devices known in the art. A main advantage of the handheld pressurized hopper gun 100 includes a simplified lightweight, robust construction. Other advantages, in combination, include a pressurized sealed hopper 104 for urging the mixed ingredients into the spray gun 106, air pressure regulation devices located in both the pathway to the pressurized sealed hopper 104 and the spray gun 106, pressurized air constantly entering the handle 110 and passing through the spray gun 106, a trigger 174 that enables the discharge of the mixed ingredients from the spray gun 106, an adjustment knob 182 that controls the range of motion of the trigger 174 and thus the volume of mixed ingredients discharged, and a plurality of different orifices 170, 204 for varying the texture and spray patterns of the mixed ingredients.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A portable handheld pressurized hopper gun for repairing damaged plaster surfaces comprising:

a spray gun;

a pressurized sealed hopper containing a sealing compound mounted over said spray gun; and a pressurized air input for providing low pressure air from an air input housing to an air regulator and said spray gun and to a cock valve and said pressurized sealed hopper;

wherein said spray gun having a handle with a first air passage formed therethrough, a movable hollow plunger shaft having a second air passage formed therethrough, a nozzle for seating an end of said hollow plunger shaft and having an orifice formed therethrough, said orifice and said second air passage being aligned and communicating with said first air passage, each constantly passing said low pressure air from said air input, and a trigger for unseating said hollow plunger shaft from said nozzle for dispensing said sealing compound through said orifice; and wherein said pressurized air input further includes a pressure gauge combined with said cock valve for controlling said low pressure air supplied to a flexible air line connected to said sealed hopper for regulating the flow rate of said sealing compound from said sealed hopper to said spray gun.

2. The portable handheld pressurized hopper gun of claim 1 wherein said pressurized hopper is comprised of plastic.

3. The portable handheld pressurized hopper gun of claim 1 wherein said pressurized hopper is comprised of aluminum.

4. The portable handheld pressurized hopper gun of claim 1 wherein said pressurized air input is rated at 15 pounds per square foot.

5. The portable handheld pressurized hopper gun of claim 1 wherein said orifice is one of a plurality of orifices for use in said nozzle.

6. The portable handheld pressurized hopper gun of claim 1 wherein said hollow plunger shaft includes a shoulder upon which said trigger abuts for unseating said hollow plunger shaft from said nozzle when said trigger is actuated.

7. The portable handheld pressurized hopper gun of claim 1 further including an adjustment knob for controlling the tension on a spring positioned between said hollow plunger shaft and said adjustment knob.

8. The portable handheld pressurized hopper gun of claim 7 wherein the tension on said spring is adjusted by a plurality of threads.

9. The portable handheld pressurized hopper gun of claim 1 wherein the position of said adjustment knob controls the travel of said trigger and the volume of said sealing compound discharged from said nozzle of said spray gun.

10. The portable handheld pressurized hopper gun of claim 1 wherein said pressurized sealed hopper further includes a threaded cap.

11. The portable handheld pressurized hopper gun of claim 1 further including a neck connected between said pressurized sealed hopper and a cavity of said spray gun to transmit said sealing compound under pressure to said spray gun.

12. The portable handheld pressurized hopper gun of claim 1 wherein said nozzle is connected to a cavity of said spray gun by a plurality of mechanical threads.

13. A portable handheld pressurized hopper gun for repairing damaged plaster surfaces comprising:

a spray gun;

a pressurized sealed hopper containing a sealing compound mounted over said spray gun; and a pressurized air input for providing low pressure air from an air input housing to an air regulator and said spray gun and to a cock valve and said pressurized sealed hopper;

wherein said spray gun having a handle with a first air passage formed therethrough, a movable hollow plunger shaft having a second air passage formed therethrough, a nozzle for seating an end of said hollow plunger shaft and having an orifice formed therethrough, said orifice and said second air passage being aligned and communicating with said first air passage, each constantly passing said low pressure air from said air input, a trigger for unseating said hollow plunger shaft from said nozzle for dispensing said sealing compound through said orifice, and an adjustment knob for controlling the travel of said trigger; and wherein said pressurized air input further includes a pressure gauge combined with said cock valve for controlling said low pressure air supplied to a flexible air line connected to said sealed hopper for regulating the flow rate of said sealing compound from said sealed hopper to said spray gun.

14. The portable handheld pressurized hopper gun of claim 13 wherein said adjustment knob further includes a spring positioned within a hollow formed within said adjustment knob.

15. The portable handheld pressurized hopper gun of claim 14 wherein said spring returns said trigger to an unactuated positioned when said trigger is released.

* * * * *